US005181626A

United States Patent [19]

Daenen et al.

[11] Patent Number: 5,181,626

[45] Date of Patent: Jan. 26, 1993

[54] CLOSURE ASSEMBLY FOR CONTAINERS

[75] Inventors: Robert H. C. M. Daenen, Erembodegem, Belgium; Stig Lillelund, Gentofte, Denmark; Masao Kato, Okazaki, Japan; Peter Lonergan, Central, Hong Kong; Augusto A. Picozza, Orlando, Fla.

[73] Assignee: Dart Industries, Inc., Deerfield, Ill.

[21] Appl. No.: 677,017

[22] Filed: Mar. 28, 1991

[51] Int. Cl.[5] ..... B65D 43/04; B65D 51/18

[52] U.S. Cl. ..... 220/282; 220/255; 220/256; 220/354; 220/307; 220/366; 220/308; 220/358

[58] Field of Search ..... 220/282, 254, 255, 256, 220/281, 354, 307, 366, 308, 344, 358

[56] References Cited

U.S. PATENT DOCUMENTS

| | | | |
|---|---|---|---|
| 2,333,117 | 11/1943 | Nyden | 220/282 |
| 2,493,277 | 1/1950 | Vandier | 220/282 |
| 3,051,350 | 8/1962 | Burdick et al. | 220/282 |
| 3,294,274 | 12/1966 | Spitzberg | 220/358 |
| 3,360,153 | 12/1967 | Wheaton, Jr. | 220/256 X |
| 3,567,064 | 3/1971 | Churan | 220/256 |
| 3,941,275 | 3/1976 | Simmons | 220/256 |
| 4,016,096 | 4/1977 | Meyer | 220/358 X |
| 4,356,930 | 11/1982 | Roper | 220/306 |
| 4,377,236 | 3/1983 | Montgomery | 220/282 X |
| 4,494,674 | 1/1985 | Roof | 220/306 |
| 4,530,442 | 7/1985 | Vogel, Jr. et al. | 220/354 |
| 4,619,373 | 10/1986 | Galer | 220/354 |
| 4,667,842 | 5/1987 | Collins | 220/307 |
| 4,667,843 | 5/1987 | Galer | 220/354 |
| 4,724,977 | 2/1988 | Cleevely et al. | 220/258 |
| 4,724,979 | 2/1988 | Cleevely et al. | 220/258 |
| 4,817,815 | 4/1989 | Stahlecker | 220/209 |
| 4,887,735 | 12/1989 | Dudzik | 220/307 |
| 4,905,861 | 3/1990 | Boxall et al. | 220/266 |
| 4,923,085 | 5/1990 | Lillelund et al. | 220/282 |
| 5,029,723 | 7/1991 | Lo | 220/282 |
| 5,097,977 | 3/1992 | Straub | 220/307 |
| 5,125,530 | 6/1992 | Straub | 220/307 |

*Primary Examiner*—Allan N. Shoap
*Assistant Examiner*—Vanessa Caretto
*Attorney, Agent, or Firm*—John A. Doninger

[57] ABSTRACT

A container closure assembly comprising a rigid lid and a separately formed flexibly resilient sealing member mounted to the lid and moveable with the lid between closed and open positions relative to the container. Rocking lugs are integrally formed with either the lid or the seal member for a rocking of the lid to an open position for removal from the container. Cooperating positioning lugs are provided to position the closed lid, with seal member, relative to the container mouth.

25 Claims, 5 Drawing Sheets

CLOSURE ASSEMBLY FOR CONTAINERS

The invention herein relates to the subject matter of U.S. Pat. No. 4,923,085, issued May 8, 1990 and commonly assigned with the present application. The disclosure of this patent is herein incorporated by reference.

BACKGROUND OF THE INVENTION

U.S. Pat. No. 4,923,085 sets forth in detail the general state of the art relating to container closures, and specifically defines a closure system utilizing a rocking lid with a depending flange which directly seals to the open mouth of a container. The lids to which the patent is directed are generally intended for use on relatively large-mouthed containers of the type normally found in the kitchen for the storing of foodstuffs. As such, and as the opening of the lid is effected by a physical rocking or pivoting of the lid about fulcrum points, the lid itself must be of a substantially rigid construction, formed for example of a polycarbonate or polystyrene. The container will preferably be formed of a similar rigid material for appropriate support of the contents.

The sealing normally achieved between the rigid container and the rigid locking lid has been found to be effective for general purposes if close manufacturing tolerances are maintained. However, a more effective sealing is frequently desired or in fact found to be necessary for a variety of products and related storing conditions.

This necessity for a more effective sealing of the lid to the container, while maintaining the highly desirable rocking nature of the lid, gives rise to a substantial problem. Basically, if a softer plastic material such as low-density polyethylene or polypropylene is used to form the lid, it is possible a more intimate seal will be achieved. However, the lid will no longer possess the high degree of rigidity need to effect the essential rocking movement thereof to allow for an opening of the lid through pressure at a designated point thereon. Rather, the flexible lid, as with known lids of a highly flexible nature, would have to be peripherally peeled from the container by the fingers grasping the edge of the lid peripherally thereabout. As such, the distinct advantages derived from the provision of a rocking lid would not be achieved.

SUMMARY OF THE INVENTION

The principal purpose of the present invention is to provide a closure system or assembly which, while generally comprising the structure, and retaining the advantages, of a rocking lid, effectively seals to the container through the interpositioning of a separately molded flexible or low-density sealing member between the rocking lid and the mouth of the container. In this manner, the difficulty in achieving an effective seal between two rigid plastic members of for example polycarbonate or polystyrene is avoided in that the rigid lid is sealed to the flexible or flexibly resilient seal member which is in turn sealed to the rigid container.

The closure assembly, notwithstanding the interpositioning of the seal member, retains the desired capability of rocking to an open position upon the application of pressure on a predesignated area or point thereon. The lid will either pivot relative to the container about fulcrum or rocking lugs integrally formed at selected points about the periphery of the seal member, or will pivot about integral depending lugs on the lid itself. In both cases, the lugs will engage the rim of the container mouth outward of the seal member with the seal member carried by the lid, in a permanent or semi-permanent manner, for movement therewith relative to the container mouth.

In one embodiment, the seal member comprises an annular seal ring mounted to and retained on the lid. In another embodiment, the seal member includes a central panel which completely overlies and closes the open mouth of the container, thus providing the primary closure for the container mouth while the associated lid forms the rigid structure which enables the desired rocking opening of the container. Such a central panel will also tend to strengthen the seal member without affecting the sealing capability thereof.

The rocking lugs, defining the fulcrum points for the rocking of the lid, comprise a pair of lugs at opposed aligned positions about the periphery of the closure assembly, for example on a chord assuming a circular container and closure assembly as illustrated. The location of the rocking lugs divide the closure assembly into a major section and a minor section to the opposite sides of the transverse plane of the fulcrums. The major section includes positioning or stabilizing lugs, normally a pair of lugs, which are of equal height with the rocking lugs to engage the container rim and, in conjunction with the rocking lugs, stabilize the lid in a closed position overlying the container mouth. The opening of the lid is effected by a downward pressure on the minor section thereof which results in the upward rocking of the major section and an opening of the lid sufficient to allow for a grasping of the lid and its removal in a simple and obvious manner.

The desirability of the provision of a lid which can be peripherally coextensive with the container, while retaining the ability to be removed therefrom in an effortless manner, as opposed for example to a screw lid, cork-type stopper, or the like, will be recognized from the discussion in U.S. Pat. No. 4,923,085. The functional advantages of the basic rocking lid are retained in the present invention, notwithstanding the incorporation of an effective means for sealing the lid, through the specific provision that the seal member engage within the open mouth of the container, and itself not extended beyond the outer periphery of the container.

Other objects and advantages will become apparent as the invention is more fully hereinafter described.

DESCRIPTION OF PREFERRED EMBODIMENTS

Figure 1:
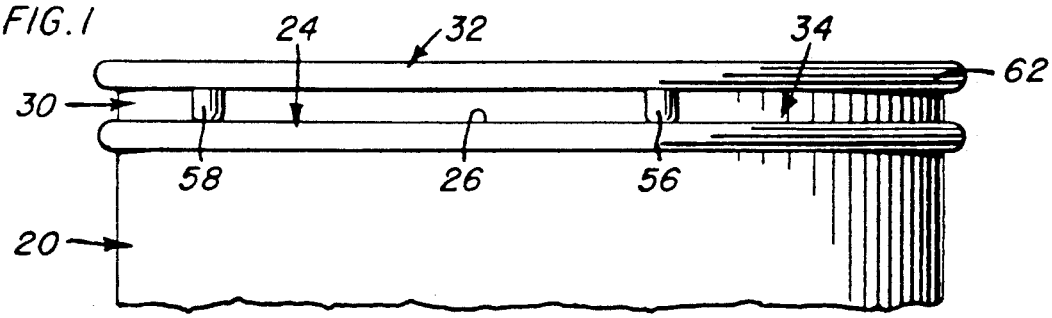
FIG. 1 is a side elevational view of a container with the closure assembly of the present invention mounted thereon.
Figure 2:
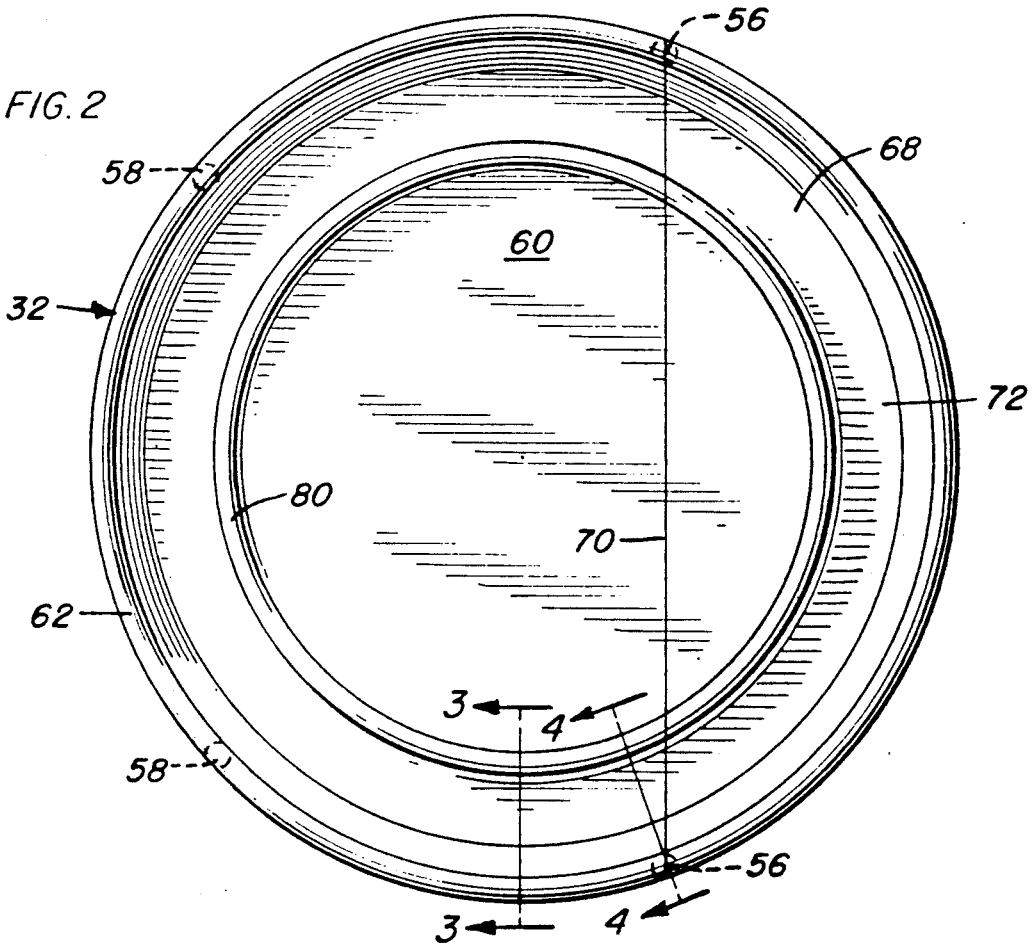
FIG. 2 is a top plan view of the closure assembly.

Referring more specifically to the drawings, and in particular FIGS. 1-7, the container 20, for purposes of illustration and description, has been presented as a cylindrical canister with an upwardly opening mouth 22 coextensive with the upper end of the canister and defined by a peripheral rim portion 24 either integrally molded with the canister wall or separately molded and intimately bonded thereto. As will be appreciated, the container can be of other configurations and the mouth relatively smaller than the full extent of the upper end of the container, for example being defined by the planar upper edge of a projecting pour spout. The container 20, along with the mouth-defining rim portion 24, is formed of a rigid plastic, for example a polycarbonate or polystyrene, with the rim portion 24 having a planar or substantially planar upper surface 26 and an inwardly directed peripheral lip-like projection 28 as a means for enhancing the frictional engagement and sealing of the closure assembly 30 to the container 20.

The closure assembly 30, while not limited thereto, has for purposes of illustration and description been presented as annular to conform to the cylindrical container. The closure assembly comprises a rigid lid 32 of, for example, a polycarbonate or polystyrene, and a seal member or ring 34 of a flexibly resilient material such as low-density polyethylene or polypropylene which is capable of intimately conforming to both the container rim portion 24 and the lid 32.

The seal ring 34 includes an annular top wall with a planar upper support surface 36 and an integral vertically depending outer sealing flange 38. The sealing flange 38, upon a mounting of the seal member or ring 34 within the container mouth 22, is in intimate peripheral engagement with the rim portion 24 and frictionally sealed thereto. The sealing of the flange 38 to the inner surface of the rim portion 24 can be enhanced by an integral lip-like continuous sealing projection 40 provided about the outer periphery of the flange 38 and engaged with the similarly formed projection 28 on the container rim portion 24.

The seal ring 34 also includes, radially inward of the outer sealing flange 38, an upwardly opening sealing groove 42. The sealing groove 42 is defined by an outer wall 44 depending from the inner annular edge of the upper support surface 36, an annular inner wall 46 inwardly spaced from the outer wall 44 and extending to the plane of the upper support surface 36 and a radially extending bottom wall 48 integrally and continuously joining the lower edges of the outer and inner walls 44 and 46, preferably slightly above the lower edge of the annular outer sealing flange 38.

In order to facilitate mounting and sealing of the lid 32, as shall be referred to subsequently, the inner wall 46, upwardly toward the open upper mouth of the groove, may diverge slightly from the outer wall 44. Similarly, the inner surface of the outer wall 44 may include an outwardly beveled upper portion 50 at the mouth of the groove 42, combining with the inclined inner wall 46 to facilitate introduction of the corresponding component on the lid 32. Further, and in order to effect an intimate seal, the inner surface of the outer wall 44, below the beveled upper portion thereof, may include an inwardly directed annular sealing recess 54.

The seal ring 34 on the periphery thereof at opposed points on the outer surface of the outer sealing flange 38, includes a pair of projecting integrally formed rocking lugs 56. The lugs 56 are on a line which divides the seal ring 34 and overlying lid 32 into a first minor section, to the right in the plan view of FIG. 2, and a second major section to the left.

The seal ring 34 includes a second pair of similarly formed lugs 58, comprising positioning or stabilizing lugs, provided at peripherally spaced points about the major section for cooperation with the rocking lugs 56 in forming a common support plane and support for the seal ring 34 when mounted within the open mouth of the container. The upper surfaces of both sets of lugs 56 and 58 are preferably coplanar with the upper support surface 36.

As will be noted from the drawings, the lugs 56 and 58 seat on the upper surface 26 of the rim portion 24 of the container 20 upon a sealing engagement of the seal ring within the open mouth of the container.

The lid 32 preferably includes a generally planar top panel 60 with an outer periphery 62 generally aligned with the rim portion 24 of the container 20 upon a mounting of the lid. The lid 32, when mounted, is sealed and fixed to the seal ring 34 by means of an integrally formed depending annular flange 64 extending from the under surface of the panel 60 in inwardly spaced relation to the periphery 62 thereof. The flange 64 is slightly outwardly inclined and adapted to engage and seal within the sealing groove 42 of the seal ring 34. This engagement of the lid flange 64 within the sealing groove 42 is facilitated by the beveled edge 50 on the outer wall 44 of the groove, with the sealing of the flange 64 into the groove 42 enhanced by an annular projection 66 on the outer surface of the flange 64 which snap-engages within the recess 54 defined in the inner surface of the outer wall 44 of the groove 42. When engaged, the lid 32 and seal ring 34 remain together and function as a unit as the closure assembly 30 is opened and closed. The seal ring can either be permanently affixed to the lid or be retained as a separate member for cleaning or replacement purposes.

Figure 3:
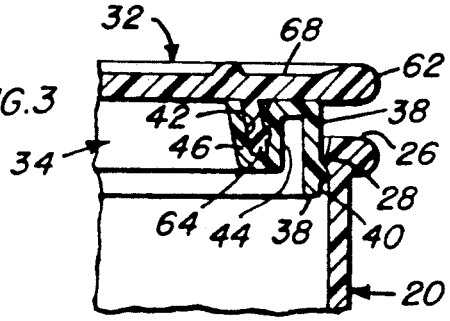
FIG. 3 is an enlarged cross sectional detail taken substantially on a plane passing along line 3—3 in FIG. 2.
Figure 4:
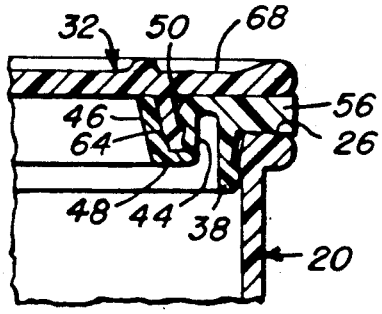
FIG. 4 is an enlarged cross sectional detail taken substantially on a plane passing along line 4—4 in FIG. 2.
Figure 5:
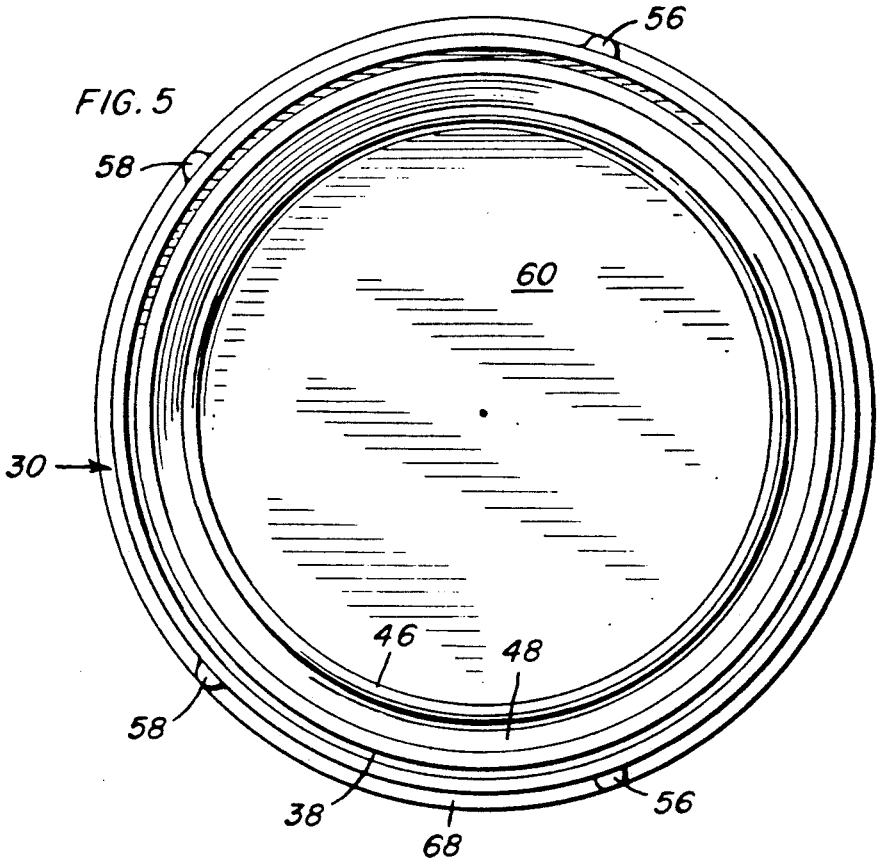
FIG. 5 is a bottom plan view of the closure assembly.
Figure 6:
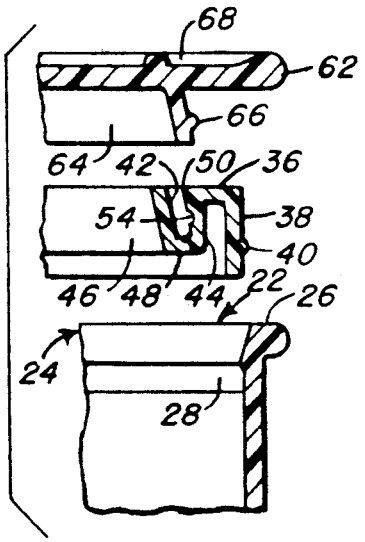
FIG. 6 is an exploded detail of the components of the closure assembly and the upper portion of the container.
Figure 7:
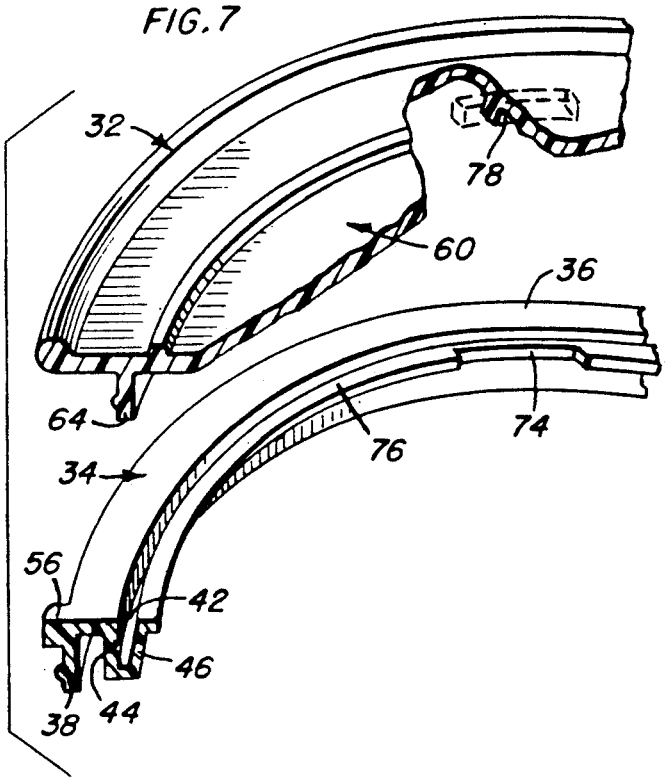
FIG. 7 is an exploded perspective detail of portions of the lid and seal member of the closure assembly.
Figure 8:
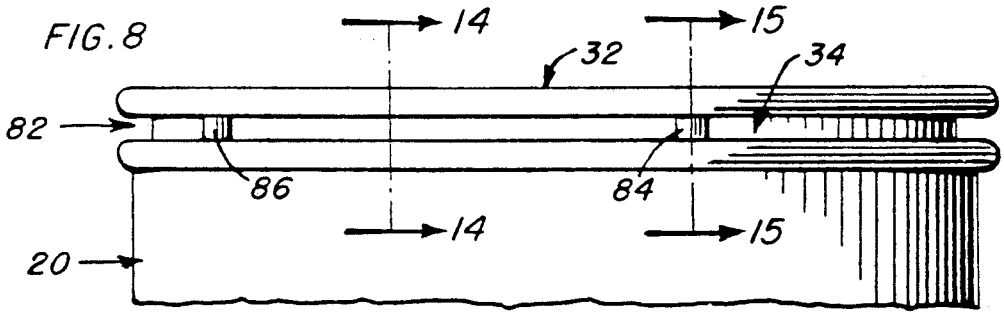
FIG. 8 is a side elevational view of the upper portion of a container with a modified form of closure assembly mounted thereon.
Figure 9:
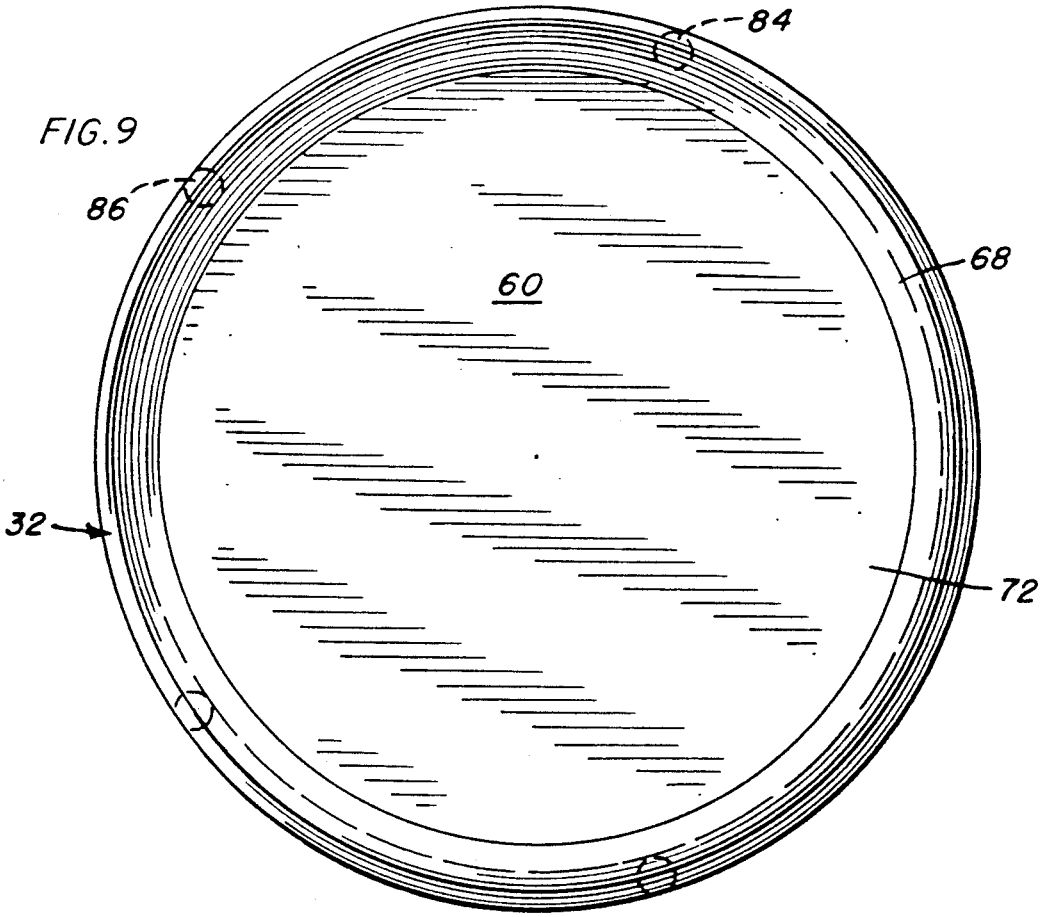
FIG. 9 is a top plan view of the structure of FIG. 8.
Figure 10:
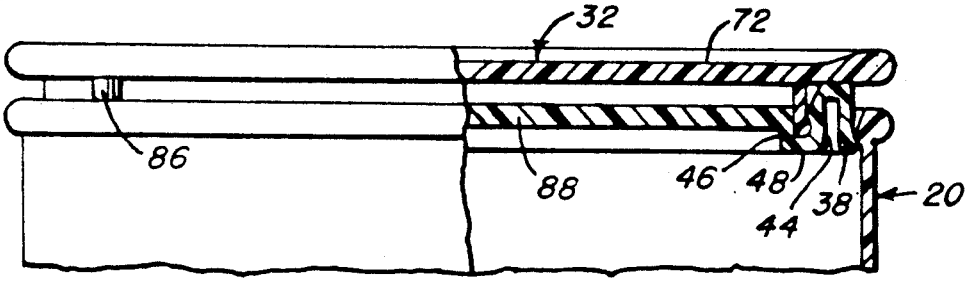
FIG. 10 is a side elevational view, partially in section, of the structure of FIG. 8.

Noting FIG. 3, it will be seen that the peripheral outer portion 68 of the lid 32, that is the portion outward of the depending sealing flange 64, projects radially outward of the outer sealing flange 38 of the seal ring 34 and, other than for the rocking and stabilizing lugs 56 and 58, freely overlies and is spaced from the upper peripheral edge 26 of the rim portion 24 of the seal ring.

The container is opened by a rocking or pivoting of the lid 32 and seal ring 34 secured thereto. The rocking of the lid is effected by a downward pressure on the peripheral outer portion 68 of the lid between the pair of rocking lugs 56 along the minor arc of the minor section defined by a chord line 70, either visible for alignment purposes or imaginary, extending between the rocking lugs 56.

While the vertical distance of movement of the minor section of the lid until contact with the upper rim portion of the container 20 is slight, the relatively greater width of the major section of the lid assures a sufficient upward pivoting of the remote portion thereof to free the lid and seal ring and allow an easy and unencumbered grasping thereof for a complete removal of the closure assembly.

The rigid nature of the lid 32 is necessary to effect the upward pivoting of the closure assembly relative to the container mouth. The flexibly resilient nature of the seal ring, in turn, is highly desirable to effect a proper sealing. The seal ring 34, and thus the entire closure assembly including lid 32, is stably retained in closed position on the container rim portion by the frictionally interengagement between the lip portions 28 and 40 on the container rim portion 2 and outer sealing flange 38 respectively. Additional stability results from the direct seating of the rocking and stabilizing lugs 56 and 58 o the upper surface 26 of the container rim portion.

When the lid 32 is moved to its closed and sealed position, through simply a downward pressure thereon, the positioning or stabilizing lugs 58, located along a smaller arc of the larger section of the lid 32 remote from the minor section, combine with the rocking lugs 56 to provide a stable support for the lid and seal in parallel overlying relation to the mouth 22 of the container 20.

Inasmuch as the rocking lugs 56 are not readily visible from the top of a closed container, it is contemplated that some appropriate means, in the nature of indicia, a structural depression or raised portion, or the like, be provided in the area 72 to indicate the preferred area for the application of pressure to upwardly rock the lid 32. The area of preferred pressure could also be indicated by the provision of a visible chord line 70.

In order to facilitate a proper alignment of the lid 32 with the seal ring 34, cooperating alignment means can be provided thereon. For example, and noting FIG. 7, the inner wall 46 of the sealing ring 34 can be provided with an alignment notch 74 provided either directly therein through the upper edge thereof, or in a peripheral inwardly directed lip 76 integrally formed with the upper edge of the inner wall 46. The lid 32, in turn, can be provided with an integral depending alignment protuberance 78 immediately inward of the sealing flange 64 and of a size to mate with and be received within the alignment notch 74 upon an appropriate alignment of the lid 32. When properly aligned, the interengagement of the seal ring with the lid ensures a proper location of the visible pressure area 72 for a pivoting of the lid and secured seal to the open position thereof. The alignment means 74, 78 can be provided at any appropriate position about the sealing ring and lid. Further, as desired, multiple alignment means can be provided.

As will be noted from the drawings, the upper surface of the lid 32 can be provided with an annular upwardly projecting rib 80 radially inwardly spaced from the outer peripheral portion thereof. This rib 80 will align with a similar depending rib of slightly lesser or greater diameter on the base of the container as a means for aligning stacked containers.

A variation of the closure assembly has been illustrated in FIGS. 8–15 and is generally designated by reference numeral 82. The closure assembly 82 closely conforms to the initially described closure assembly 30 in both structure and manner of operation. Accordingly, like parts and like components have been indicated by like reference numerals.

One area of specific difference involves the forming of both the rocking lugs 84 and the positioning or stabilizing lugs 86 integrally with and depending from the undersurface cf the outer peripheral portion 68 of the lid 32. These lugs 84 and 86, as will be appreciated from the drawings, freely seat on the upper support surface 26 of the rim portion 24 of the container 20 and are peripherally positioned in the same manner as the lugs 56 and 58, along with designated minor and major lid sections. Inasmuch as the rocking lugs 84 are integrally formed with the lid 32, and thus always at a fixed position relative to the desired pressure point, indicated by appropriate means in the area 72, the necessity for a specific rotational alignment of the lid 32 relative to the seal member 34 is avoided.

The seal member 34 of the modified closure assembly 82, which also is of a seal-enhancing flexibly resilient resinous material, differs only in the incorporation therein of a continuous disk-like membrane or panel 88 integrally formed with the upper edge of the inner wall 46 of the sealing groove 42. This inner wall 46 may, as illustrated, terminate in spaced relation below the upper support surface 36 of the seal member 34, thus defining a sealed space 90, for insulating purposes or the like, between the membrane 88 and the overlying lid panel 60. The membrane 88, in addition to providing additional sealing capability, will also tend to strengthen the seal member or ring 34 without affecting the flexibly resilient sealing capability thereof with both the container 20 and the lid 32.

Figure 11:
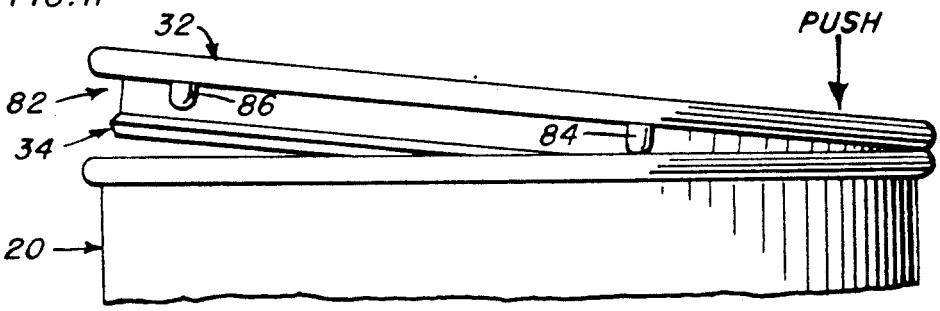
FIG. 11 is a side elevational view illustrating the closure assembly in its upwardly rocked release or open position.
Figure 12:
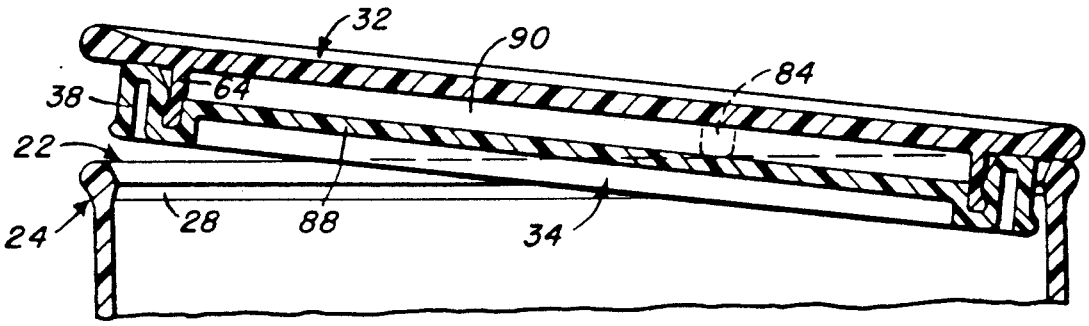
FIG. 12 is an enlarged cross sectional view through the partially open closure assembly.
Figure 13:
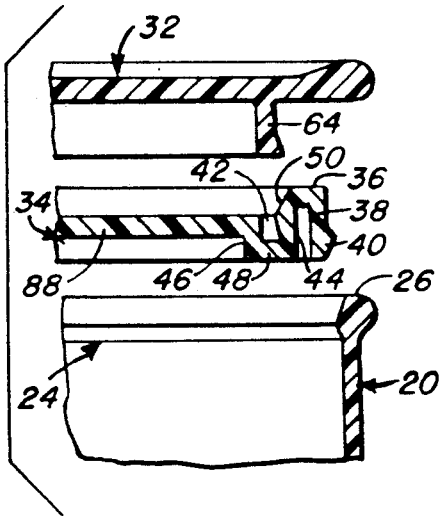
FIG. 13 is an exploded cross sectional detail of the components of the closure assembly of FIG. 8 and the upper portion of the container.
Figure 14:
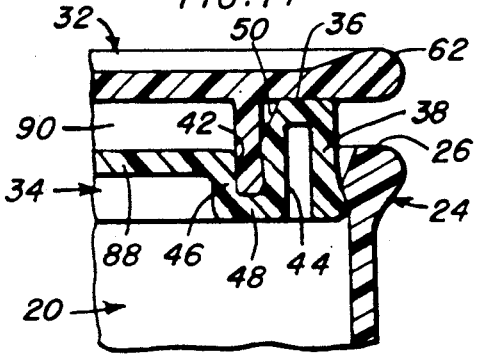
FIG. 14 is an enlarged cross sectional detail taken substantially on a plane passing along line 14—14 in FIG. 8.
Figure 15:
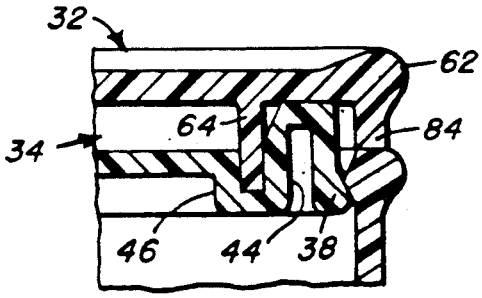
FIG. 15 is an enlarged cross sectional detail taken substantially on a plane passing along line 15—15 in FIG. 8.
Figure 16:
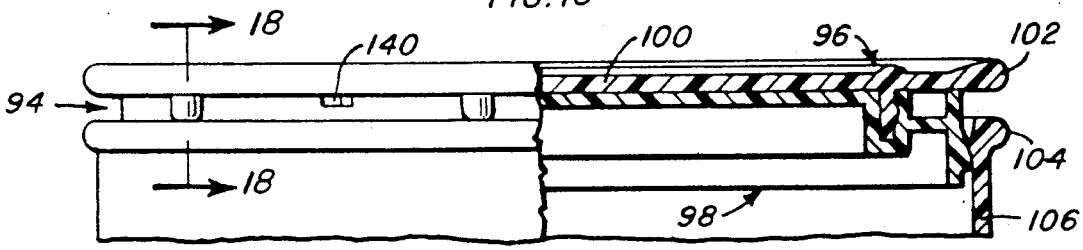
FIG. 16 is a side elevational view, partially in section, of the upper portion of a container with a further modified for of closure assembly mounted thereon.
Figure 17:
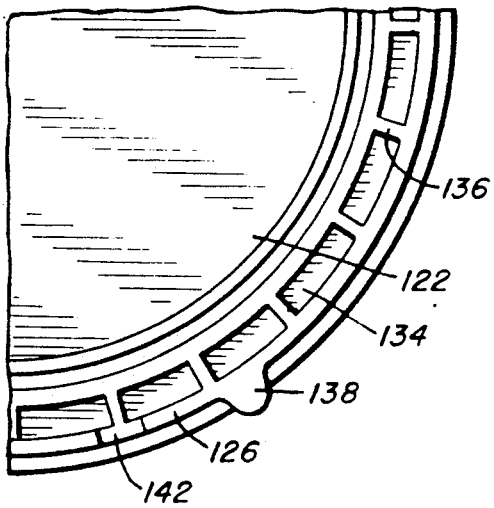
FIG. 17 is a partial top plan view of the seal member prior to mounting to the lid.

As with the closure assembly 30, and as will be best appreciated from FIGS. 11 and 12, the sealing member 34, when mounted to the lid 32, is retained thereon, either through the frictional sealing engagement therebetween or possibly by a permanent affixing thereto, whereby the lid and seal move as a unit between the closed and opened positions. Formed in this manner, the closure assembly effectively combines the flexible resiliency need to obtain the desired seal, and the lid rigidity necessary to enable a pivotal rocking of the lid for a release thereof. To form the closure assembly solely of a rigid member would not provide for the effective seal required in many instances. Similarly, to form the entire assembly of a material providing the required flexible resiliency for an effective seal, would not provide the rigidity necessary for a rocking of the lid. The separate formation of the lid and the seal member, and the subsequent combining into a unitary closure assembly ensure the unique combination of advantages required by the present invention.

With further reference to the closure assembly 82, it will be appreciated that, in the closed position, the height of the rocking and stabilizing lugs 84 and 86 is such as to position the closed closure assembly at a height relative to the container mouth whereat the outer sealing flange 38 of the seal member 34 is retained in positive sealed engagement within the container mouth.

A further variation of the closure assembly has been illustrated in FIGS. 16-20, and is generally designated by reference numeral 94. The closure assembly 94 generally conforms to the two previously described closure assemblies in both structure and manner of operation, and likewise includes a rigid lid 96 and a seal member 98 of an appropriate seal-enhancing flexibly resilient resinous material.

The lid 96 substantially duplicates the lid 32 of the embodiment of FIGS. 1-7, and similarly includes a top planar panel 100 with an outer peripheral edge 102 which generally aligns over the rim portion 104 of the container 106. The lid also includes an integrally formed depending annular flange 108 extending from the undersurface of the panel 100 in inwardly spaced relation to the peripheral edge 102.

The seal member 98 includes an annular upwardly facing sealing groove 110 which receives the depending lid flange 108 therein in a manner sufficient to fix the seal member 98 to the lid 96. The sealing groove is defined by annular inner and outer walls 112 and 114 integrally joined by an annular bottom wall 116.

The upper edge 120 of the outer wall 114 defines a support surface against which the undersurface of the lid panel 100 engages upon full insertion of the flange 108 within the sealing groove 110. The corresponding upper edge of the inner wall 112 is of equal height with or slightly below the support edge 120 and is integrally formed with a central imperforate panel or membrane 122 peripherally thereabout. The sealing member panel 122 immediately underlies the planar top panel 100 of the lid 96 to enhance the sealing and insulating capability thereof.

The sealing member includes an annular vertically extending outer peripheral sealing flange 124 surrounding the outer wall 114 in outwardly spaced relation thereto and including an upper edge 126 coplanar with the upper edge 120 and similarly defining the support surface for the overlying lid panel 100. The outer sealing flange 124 extends below the bottom wall 116 of the sealing groove 110 and includes, peripherally about the outer surface thereof, a sealing projection or lip 128 which cooperates with a similar lip-like projection 130 peripherally about the inner surface of the container 106 at the open upper end thereof. The cooperating lips 128 and 130 have inclined faces which produce a slight inward camming of the lower portion of the sealing flange 124 as the closure assembly is introduced into the upper end of the container with the projection 128 moving inwardly past the projection 130 and releasably locking therebeneath in a manner which defines an annular seal between the closure assembly and the container.

As desired, a series of peripherally spaced very small protuberances 132 can be provided on the lower inclined face of the seal member projection 128 to allow for a continuous venting of the interior of the container until the closure assembly is fully seated with the sealing member projection immediately below the container projection 130. In other words, without the small protuberances or spacing elements 132, with close tolerances, it is possible the annular sealing projection 128 will seal to the container projection 130 immediately upon engagement with the upper surface thereof and prior to a full seating of the closure assembly, thus in some instances causing a slight pressure increase as the closure assembly is seated.

The outer sealing flange 124 is integrally formed with the outer groove forming wall 114 through a flat horizontal annular web 134 extending therebetween and of a radial width slightly greater than that of the sealing groove 110. This web 134 is positioned at a height between the upper and lower ends of the outer wall 114 and well below the upper support surface defined by the upper edges 120 and 126 respectively of the outer wall 114 and sealing flange 124.

The web 134, integrally formed with the outer sealing flange 124 below the upper edge, provides for an enhanced rigidification of this member as compared to the previously described members wherein the outer sealing flanges are mounted or engaged solely at the extreme upper edges thereof.

Further stability is introduced into the outer sealing flange 124 by a series of thin radially extending ribs 136 integrally formed between the outer sealing groove wall 114 and outer sealing flange 124 immediately above the web 134 and at equally spaced points about the periphery of the upwardly directed groove wall 114 provided between the groove and sealing flange 124. These ribs 136 are similarly integral with the annular web 134 and preferably project to an even height with the upper edges 120 and 126. The ribs 136 are particularly effective in stabilizing the outer sealing flange 124 as the sealing flange is engaged within and disengaged from the upper end of the container 106. In other words, the reinforcing ribs 136 tend to both retain the lower sealing portion of the outer sealing flange 124 in proper sealing engagement within the container, and also return the outer sealing flange to its proper or most effective sealing position after deflection of the flange as naturally occurs during the mounting of the closure assembly.

Figure 18:
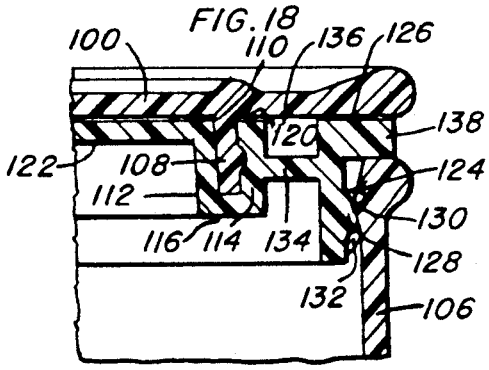
FIG. 18 is an enlarged cross sectional detail taken substantially on a plane passing along line 18—18 in FIG. 16.
Figure 19:
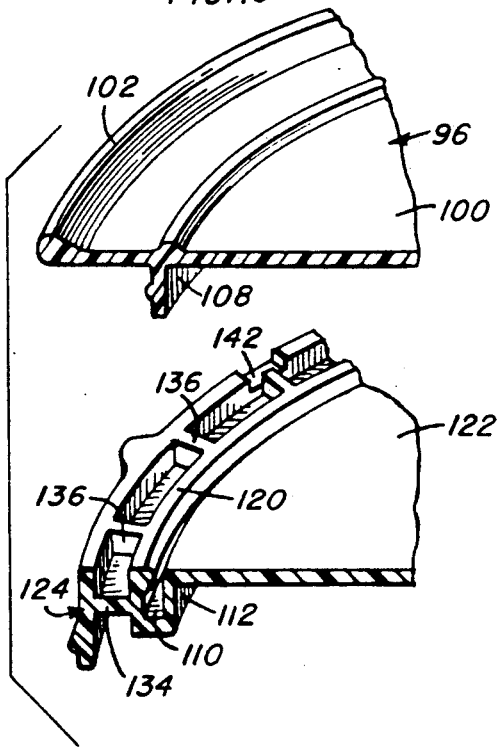
FIG. 19 is an exploded perspective detail of portions of the lid and seal member.
Figure 20:
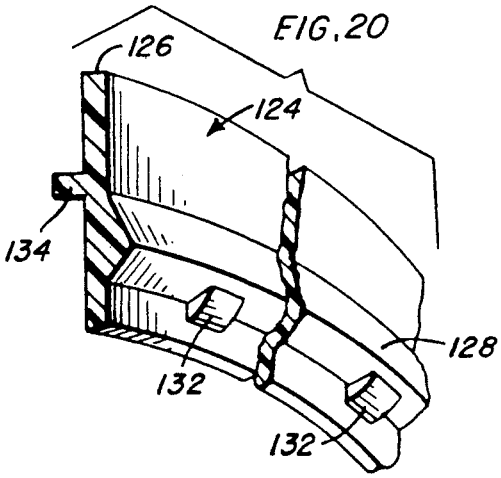
FIG. 20 is an enlarged detail of the seal member illustrating the venting protuberances.

With regard to the rocking of the closure assembly 94, the rocking lugs and positioning lugs are formed on the seal member 98 itself, as with the first described embodiment and as suggested at 138 in FIG. 18. In addition, in order to properly orient the lid 96 relative to the rocking lugs, appropriate alignment means, in the nature of a depending protuberance 140 on the lid 96, and alignment notch 142 in the upper edge portion of the sealing flange 124, are provided.

The foregoing is illustrative of the principals of the invention. Variations and modifications may occur to those skilled in the art. As such, it is not desired to limit the invention to the exact constructions shown and described.

We claim:

1. A closure assembly for a container mouth; said closure assembly comprising a seal member of flexibly resilient material, said seal member having an outer periphery including means for sealing said seal member to the container mouth, a separately formed rigid lid, means for sealing said lid to said seal member in overlying relation thereto and comprising an upwardly directed sealing groove formed within said seal member and spaced inward of said outer periphery thereof and a depending flange integral with said lid and received within said sealing groove, and fulcrum means on said closure assembly below said overlying lid and outward of said outer periphery of said seal member for rocking movement of said lid thereabout between a first closed position to generally parallel and seal the container mouth, and an open position wherein a portion of the lid is upwardly pivoted relative to and away from said closed position, said seal member being fixed to said lid for movement of said seal member with said lid between said closed and open positions said lid and seal member together defining removable closure means for repeated and routine opening and closing of the container mouth.

2. The closure assembly of claim 1 wherein said fulcrum means includes a pair of rocking lugs aligned transversely across said closure assembly.

3. The closure assembly of claim 2 wherein the aligned lugs divide said closure assembly into a minor section and major section.

4. The closure assembly of claim 3 including stabilizing lugs about said major section at spaced points along said outer periphery of said seal member.

5. The closure assembly of claim 4 wherein said rocking lugs and said stabilizing lugs are integral with said seal member.

6. The closure assembly of claim 4 wherein said rocking lugs and said stabilizing lugs are integral with said lid.

7. A closure assembly for a container mouth; said closure assembly comprising a seal member with an outer periphery and including means for sealing said seal member to the container mouth, a separately formed lid, means for sealing said lid to said seal member in overlying relation thereto and comprising, an upwardly directed sealing groove formed within said seal member and a depending flange integral with said lid and received within said sealing groove, and fulcrum means on said closure assembly below said overlying lid and outward of said outer periphery of said seal member for rocking movement of said lid thereabout between a first closed position to generally parallel and seal the container mouth, and an open position wherein a portion of the lid is upwardly pivoted relative to and away from said closed position, said means for sealing said seal member to the container mouth comprising an outer peripheral flange engageable within the mouth of the container, said seal member including an integral upper support surface between said seal member outer peripheral flange and said sealing groove, said lid engaging said upper support surface.

8. The closure assembly of claim 7 wherein said fulcrum means is aligned transversely across said closure assembly along a line dividing said closure assembly into a minor section and a major section.

9. The closure assembly of claim 8 including stabilizing means below said overlying lid and outward of said outer periphery of said seal member about said major section of said closure assembly, said fulcrum means and said stabilizing means being of substantially equal height below said lid.

10. The closure assembly of claim 9 wherein said fulcrum means comprises a pair of lugs integral with said seal member and projecting outwardly relative to said outer periphery.

11. The closure assembly of claim 9 wherein said fulcrum means comprises a pair of lugs integral with and depending from said lid.

12. The closure assembly of claim 7 wherein said seal member includes venting means on said outer peripheral flange of said seal member for venting the container as said seal member is sealed to the container mouth.

13. The closure assembly of claim 12 wherein said outer peripheral flange has an outer face, a sealing projection continuously about said outer face and adapted to engage with and move inward of and seal to a complementary projection in the container mouth, said venting means comprising a series of protuberances immediately below said sealing projection for engagement with the complementary projection in the container mouth as said sealing projection engages with the complementary projection to define venting spaced therebetween prior to movement of said sealing projection inward of the complementary projection.

14. A closure assembly mountable to a container having a mouth-encircling rim; said closure assembly comprising a seal member of flexibly resilient material for intimate sealing engagement with the container mouth, means for releasably sealing said seal member to the container mouth, a separately formed rigid lid, means for sealing said lid to said seal member and fixing said lid to said seal member in overlying relation thereto for movement of said seal member with said lid, fulcrum means on said closure assembly for engagement with the container rim for rocking movement of said rigid lid and seal thereabout between a first closed position to generally parallel and seal the container mouth, and an open position wherein a portion of said lid and seal to one side of said fulcrum means is outwardly pivoted relative to the closed position by direct pressure on said rigid lid on a second portion of said lid to the opposite side of said fulcrum means from said one side, said seal member including an outer periphery, said fulcrum means being located outward of said outer periphery and below said lid, said fulcrum means being integral with said seal member, and cooperating alignment means on said seal member and said lid for alignment of said lid at a predetermined position on said seal member.

15. The closure assembly of claim 14 wherein said fulcrum means is aligned transversely across said closure assembly along a line dividing said closure assembly into a minor section and a major section.

16. The closure assembly of claim 15 wherein said fulcrum means comprises a pair of rocking lugs projecting from the outer periphery of said seal member.

17. A closure assembly mountable to a container having a mouth-encircling rim; said closure assembly comprising a seal member of flexibly resilient material for intimate sealing engagement with the container mouth, means for releasably sealing said seal member to the container mouth, a separately formed rigid lid, means for sealing said lid to said seal member and fixing said lid to said seal member in overlying relation thereto for movement of said seal member with said lid, fulcrum means on said closure assembly for engagement with the container rim for rocking movement of said rigid lid and seal thereabout between a first closed position to generally parallel and seal the container mouth, and an open position wherein a portion of said lid and seal to one side of said fulcrum means is outwardly pivoted relative to the closed position by direct pressure on said rigid lid on a second portion of said lid to the opposite side of said fulcrum means from said one side, said seal member including an outer periphery, said fulcrum means being located outward of said outer periphery and below said lid, said means for sealing said lid to said seal member comprising an upwardly directed sealing groove in said seal member and a depending lid flange on said lid receivable within said sealing groove, said groove in said seal member including a peripheral inner wall, and a central panel integral with said inner wall peripherally thereabout and transversely across said seal member.

18. The closure assembly of claim 17 wherein said fulcrum means is aligned transversely across said closure assembly along a line dividing said closure assembly into a minor section and a major section, and said seal member includes a peripheral support surface underlying said lid, said means for sealing said seal member to the container mouth comprising an outer peripheral sealing flange depending from said support surface for engagement within the mouth of the container.

19. The closure assembly of claim 18 including stabilizing means outward of said major section along said outer periphery of said seal member, said fulcrum means and said stabilizing means being of substantially equal height and defining a common support plane for said closure assembly in said closed position thereof.

20. The closure assembly of claim 19 wherein said sealing groove includes a peripheral outer wall and a bottom wall extending between said groove inner and outer walls, said outer peripheral sealing flange on said seal member being outwardly spaced from said groove outer wall and integrally joined thereto by a transverse web therebetween generally parallel to and in vertically spaced relation below said seal member support surface, said outer peripheral sealing flange on said seal member including a lower edge vertically spaced below said web, and an upper edge defining at least a portion of said peripheral support surface on said seal member vertically above said web.

21. The closure assembly of claim 20 wherein said peripheral outer wall of said sealing groove includes an upper edge substantially coplanar with said upper edge of said outer peripheral flange and defining a portion of said peripheral support surface.

22. The closure assembly of claim 21 including a plurality of spaced reinforcing ribs integral with and extending transversely between said sealing groove outer wall and said outer peripheral sealing flange above said web.

23. The closure assembly of claim 22 including venting means on said outer peripheral sealing flange for venting the container as the closure assembly is mounted to the container.

24. The closure assembly of claim 23 wherein said outer peripheral sealing flange has an outer face, a sealing projection continuously about said outer face and adapted to engage with and move inward of and seal to a complementary projection in the container mouth, said venting means comprising a series of protuberances immediately below said sealing projection for engagement with said complementary projection in said container mouth as said sealing projection engages with said complementary projection to define venting spaces therebetween prior to movement of said sealing projection inward of said complementary projection.

25. A closure assembly mountable to a container having a mouth-encircling rim; said closure assembly comprising a seal member of flexibly resilient material for intimate sealing engagement with the container mouth, means for releasably sealing said seal member to the container mouth, a separately formed rigid lid, means for sealing said lid to said seal member and fixing said lid to said seal member in overlying relation thereto for movement of said seal member with said lid, fulcrum means on said closure assembly for engagement with the container rim for rocking movement of said rigid lid and seal thereabout between a first closed position to generally parallel and seal the container mouth, and an open position wherein a portion of said lid and seal to one side of said fulcrum means is outwardly pivoted relative to the closed position by direct pressure on said rigid lid on a second portion of said lid to the opposite side of said fulcrum means from said one side, said seal member including an outer periphery, said fulcrum means being located outward of said outer periphery and below said lid, said fulcrum means being aligned transversely across said closure assembly along a line dividing said closure assembly into a minor section and a major section, said seal member including a peripheral support surface underlying said lid, said means for sealing said seal member to the container mouth comprising an outer peripheral sealing flange depending from said support surface for engagement within the mouth of the container, said means for sealing said lid to said seal member comprising an upwardly directed sealing groove in said seal member and a depending lid flange on said lid receivable within said sealing groove, said sealing groove including a peripheral outer wall and a bottom wall extending between said groove inner and outer walls, said outer peripheral sealing flange on said seal member being outwardly spaced from said groove outer wall and integrally joined thereto by a transverse web therebetween generally parallel to and in vertically spaced relation below said seal member support surface, said outer peripheral sealing flange on said seal member including a lower edge vertically spaced below said web, and an upper edge defining at least a portion of said peripheral support surface on said seal member vertically above said web, said peripheral outer wall of said sealing groove including an upper edge substantially coplanar with said upper edge of said outer peripheral flange and defining a portion of said peripheral support surface.

* * * * *